United States Patent [19]

Tymn

[11] Patent Number: 4,962,367

[45] Date of Patent: Oct. 9, 1990

[54] REMOTELY ACTIVATED TIMER ALERT SYSTEM

[76] Inventor: Gary P. Tymn, 1119 Song Ct., San Jose, Calif. 95131

[21] Appl. No.: 291,494

[22] Filed: Dec. 29, 1988

[51] Int. Cl.[5] ..... G08B 1/00

[52] U.S. Cl. ..... 340/309.4; 340/539; 455/68

[58] Field of Search ..... 340/309.4, 309.5, 539, 340/573; 455/66, 68; 368/243, 248

[56] References Cited

U.S. PATENT DOCUMENTS 4,218,871 8/1980 Moritani ..... 368/109
4,361,408 11/1982 Wirtschafter ..... 368/10
4,641,125 2/1987 Pesa ..... 340/309
4,690,566 9/1987 Robertsen ..... 368/108
4,737,771 4/1988 Coach ..... 340/539

*Primary Examiner*—Joseph A. Orsino
*Assistant Examiner*—Frank M. Scutch, III

[57] ABSTRACT

A remotely activated timer alert system device is provided, which is particularly suitable for controlling coffee breaks and lunch breaks when used in conjunction with the catering truck industry. This timer alert system device, when remotely activated by a transmitting device, would cause a sensible alert signal of a predetermined duration to signal the beginning and the end of a preselected time interval.

12 Claims, 4 Drawing Sheets

REMOTELY ACTIVATED TIMER ALERT SYSTEM

FIELD OF THE INVENTION

The present invention relates generally to the field of timing and alert signaling devices and, more specifically to a remotely activated timer alert system for signaling the beginning and end of a preselected time interval.

BACKGROUND OF THE INVENTION

In the business environment, controlling coffee and lunch breaks has primarily been performed by devices that sound a signal at the exact time that the coffee break or lunch break should begin and end. In most cases, these time recording or time clock devices are commercially available and would be programmed to sound signals throughout the day at specific designated times.

Many companies today are making use of the catering truck industry to provide their employees with beverages and food at the employer's location. These catering trucks seldom arrive at the customer's location at the same time each day. This could be due to traffic delays, longer stops at previous customer's locations or in some cases, they may arrive early. As an example, if a time clock were programmed to sound a signal at 9:00 AM and at 9:15 AM, denoting a 15 minute coffee break, and the coffee truck were to arrive at 8:55 AM, the employees' coffee break would be stretched to 20 minutes instead of 15 minutes. This could cost a company hundreds to thousands of dollars each year in non-productive time. If the coffee truck were late by 5 minutes, the time clock apparatus would sound the signal at 9:00 AM, the employees would stop working and wait for the truck to arrive, again wasting valuable productive time Although these time clock apparatus work well for break or lunch times that are always the same every day, they cannot solve the problem when these times deviate or vary from day to day as is the case when catering truck services are used. One solution may be to use a timing alert device.

The prior art shown in U.S. Pat. No. 4,218,871 describes a programmable timer that sounds a signal at the end of the timing cycle and then repeats the same timing cycle. This timer does not give a starting audible signal and must be manually activated. There are no provisions for remote activation.

The prior art shown in U.S. Pat. No. 4,361,408 describes a pre-set interval timer that sounds an alarm at the end of the elapsed time period to remind users to take their medication. Again, no provisions are made for an audible signal at the start of the timing period nor can the timer be remotely activated.

The prior art shown in U.S. Pat. No. 4,690,566 describes a timer used in a supervisory capacity with children in which the programmable time intervals are accumulative and where an audible signal is sounded at the end of the time cycle. The timer must be manually activated and no provisions are made for remote activation or audible signals at the beginning of the timer cycle.

The prior art shown in U.S. Pat. No. 4,641,125 describes a meter beater timer which alerts the user when the parking meter time limit has elapsed so that more coins can be inserted into the meter. Again, the timer must be manually activated and no provisions are made for remote activation or audible signals at the beginning of the timer cycle.

SUMMARY OF THE INVENTION

It is an object of the present invention to provide a timer alert signaling system device, when remotely activated by a transmitting device, capable of transmitting an EMR (electromagnetic-radiation) signal, such as a hand held radio frequency transmitter, would cause an audible signal, of a predetermined duration to sound at the beginning and at the end of a preselected time interval. An example of this would be when a catering truck driver arrives at a customers location, he would push the hand held radio frequency transmitter. An audible signal lasting for a predetermined time of 3, 4 or 5 seconds would be heard inside the customer's location. The employees would then come outside to get their refreshments and start their break. The catering truck would leave and at a preselected time interval, a second audible signal would sound inside the plant telling the employees to return to work, thus solving the problem of controlling a coffee or lunch break while utilizing the services of a catering truck. An advantage to the catering truck driver must also be noted as it allows the driver latitude in the times he can arrive at a customer's location.

Another object of the present invention is to provide a second preselectable timing interval, having a beginning and ending sensible alert signal, such as an audible signal, completely different from the first preselected timing interval. Both the first and second preselected timing intervals would be activated by a remote transmitting device. As an example, the first preselected timing interval could be a coffee break and the second preselected timing interval could be a lunch break.

Yet another object of the present invention is to provide a warning audible signal, of a predetermined duration to occur two (2) minutes before the end of the preselected time interval. This would allow employees time to get back to their work stations before the break period is over.

Still another object of the present invention is to provide two (2) physically different audible signals, located some distance from each other, without connecting wires between them. An example of this would be if audible signals were needed to be heard in a manufacturing plant and in an office area, one being isolated from the other.

DETAILED DESCRIPTION OF THE EMBODIMENTS OF THE INVENTION

Figure 1:
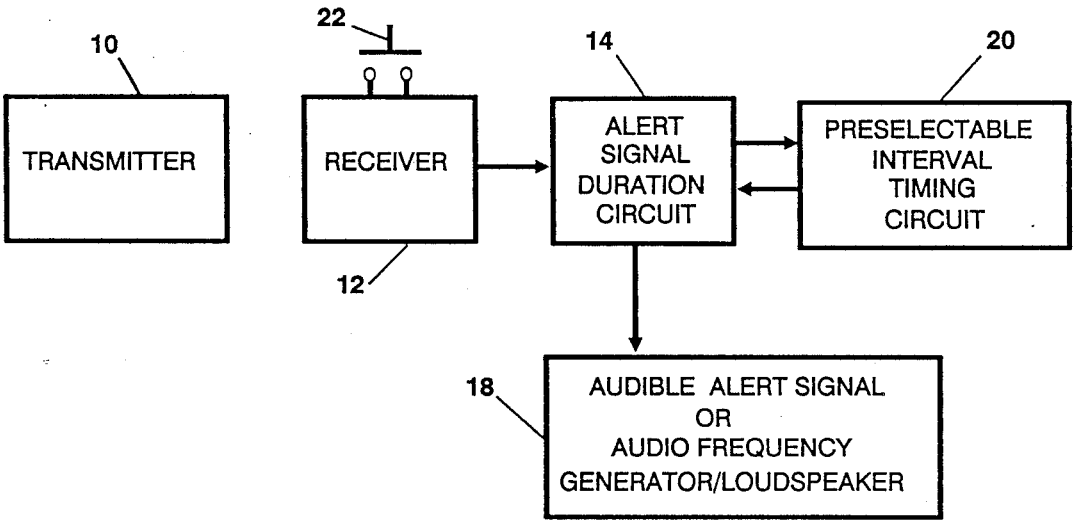
FIG. 1 is a block diagram illustrating an arrangement of the components and circuitry which may make up the preferred embodiment of the invention.

The block diagram illustrating a circuit for the preferred embodiment of the invention is shown in FIG. 1. Transmitter 10, capable of transmitting an EMR (electromagnetic-radiation) signal and receiver 12, capable of receiving an EMR signal, such as a standard radio frequency garage door opener type, make up the actuating circuit. The output stage of the receiver, upon receiving the transmitted EMR signal, changes states, causing in this case, a contact closure. The override switch 22 performs the same function as the output stage of receiver 12 except that it is a manual operation. The output stage of receiver 12 is coupled to the alert signal duration circuit 14, a simple timing circuit adjustable for 3, 4 or 5 seconds by the use of a dip switch arrangement, part of the circuitry found in alert signal duration circuit 14. Once initial activation occurs, no further activation will be possible until the alert operational cycle is complete. The output stage of receiver 12 is also coupled to the preselectable interval timing circuit 20, a conventional count down timer, adjustable from 1 to 60 minutes by the use of a dip switch arrangement, part of the circuitry found in the preselectable interval timing circuit 20. At the completion of the preselected timing interval, the alert signal duration circuit 14 is triggered again. The output is directed to the audible alert signal or audio frequency generator/-loudspeaker 18. The block diagram also includes a power supply and associated circuitry (not shown).

Operation begins when the catering truck driver pushes the button on transmitter 10. An EMR signal is transmitted to receiver 12 activating the output stage, causing contact closure within receiver 12. If the catering truck should not arrive, override push button 22 is provided for the user to manually activate the alert operational cycle. Power flowing from the output stage of receiver 12, activates the alert signal duration circuit 14. The audible alert signal or audio frequency generator/loudspeaker 18 such as a bell or horn is activated during the period that the alert signal duration circuit 14 is active.

Figure 2:
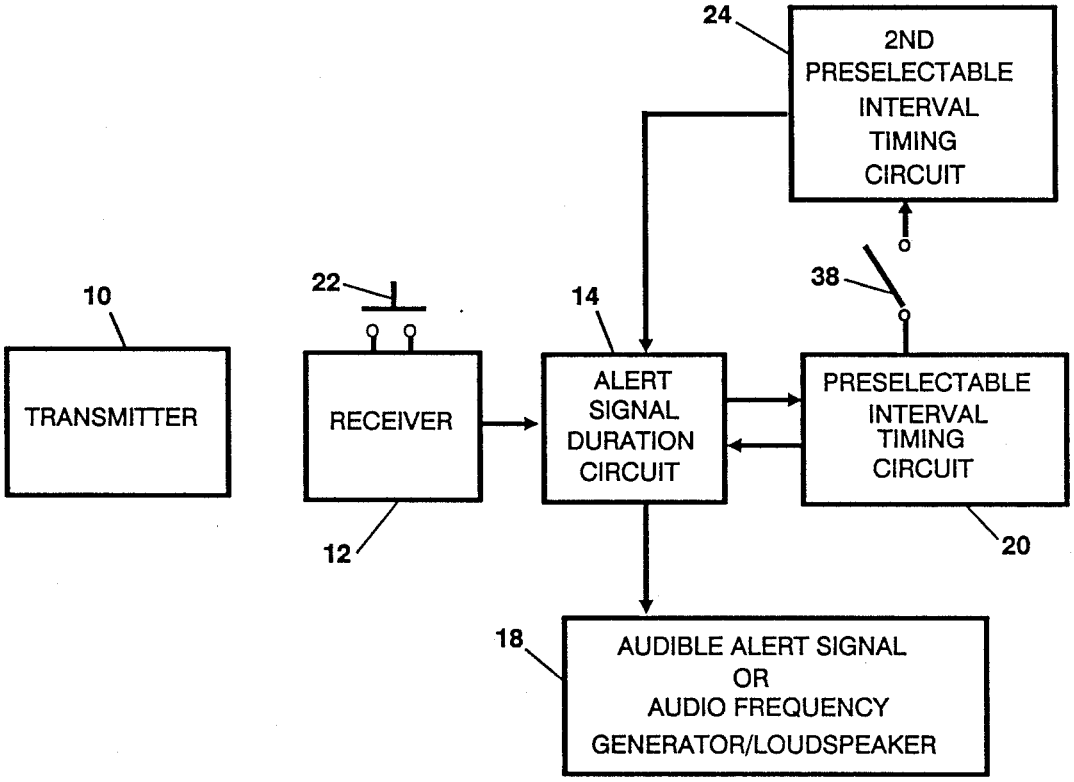
FIG. 2 is a block diagram illustrating an arrangement of the components circuitry which may make up an alternative embodiment of the invention.

The block diagram illustrating a circuit for an alternative embodiment of the invention is shown in FIG. 2. All components including 10, 12, 14, 18, 20 and 22, remain the same as in FIG. 1. The difference being the addition of a second preselectable timing circuit 24. Through the use of switch 38, the second preselectable timing interval circuit 24 is either inserted or deleted from the circuitry. When transmitter 10 or push button 22 is activated, the preselected timing interval circuit 20 and the second preselected timing interval circuit 24 alternate their timing cycles with each successive activation of transmitter 10 or push button 22.

The operation is identical to the operation in FIG. 1 except after the catering driver initiates the first preselected timing interval cycle with transmitter 10, he can at a later time, initiate the second preselected timing interval cycle by pushing the same transmitter 10. This could be used to sound a 15 minute coffee break in the morning, and later, a 30 minute lunch break in the afternoon.

Figure 3:
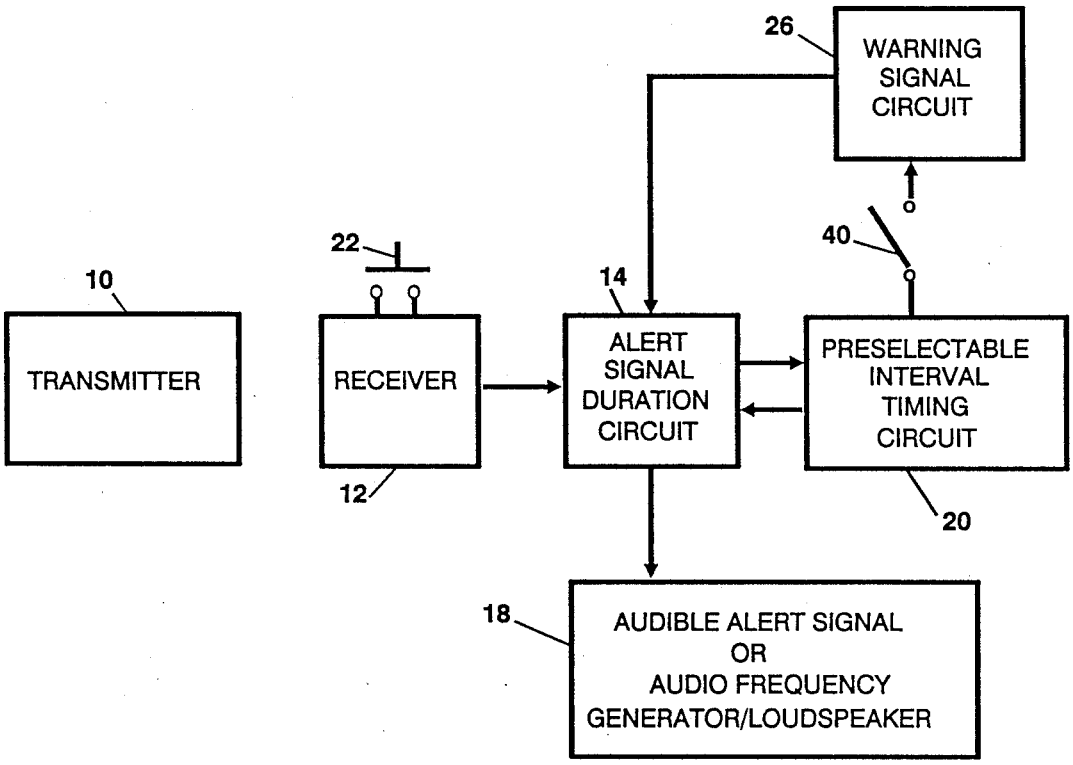
FIG. 3 is a block diagram illustrating an arrangement of the components and circuitry which may make up a further alternative embodiment of the invention.

The block diagram illustrating a circuit for a further alternative embodiment of the invention is shown in FIG. 3. All components including 10, 12, 14, 18, 20 and 22, remain the same as in FIG. 1. The difference being the addition of a warning signal circuit 26. Through the use of switch 40, the warning signal circuit 26 is either inserted or deleted into the preselectable timing interval circuit 20 and activates the sensible alert signal or audible frequency generator/loudspeaker 18 two (2) minutes prior to the end of the preselected timing interval. The operation is identical to the operation in FIG. 1 except after the catering driver activates transmitter 10, and the sensible alert signal or audio frequency generator/ loudspeaker is activated, 2 minutes before the end of the preselected timing interval, the warning signal circuit 26 activates, by way of alert signal duration circuit 14, the audible alert signal or audio frequency generator/loudspeaker 18. A third activation of the audible alert signal or audio frequency generator/loudspeaker 18 will occur at the end of the preselected timing interval as was the case in FIG. 1.

Figure 4:
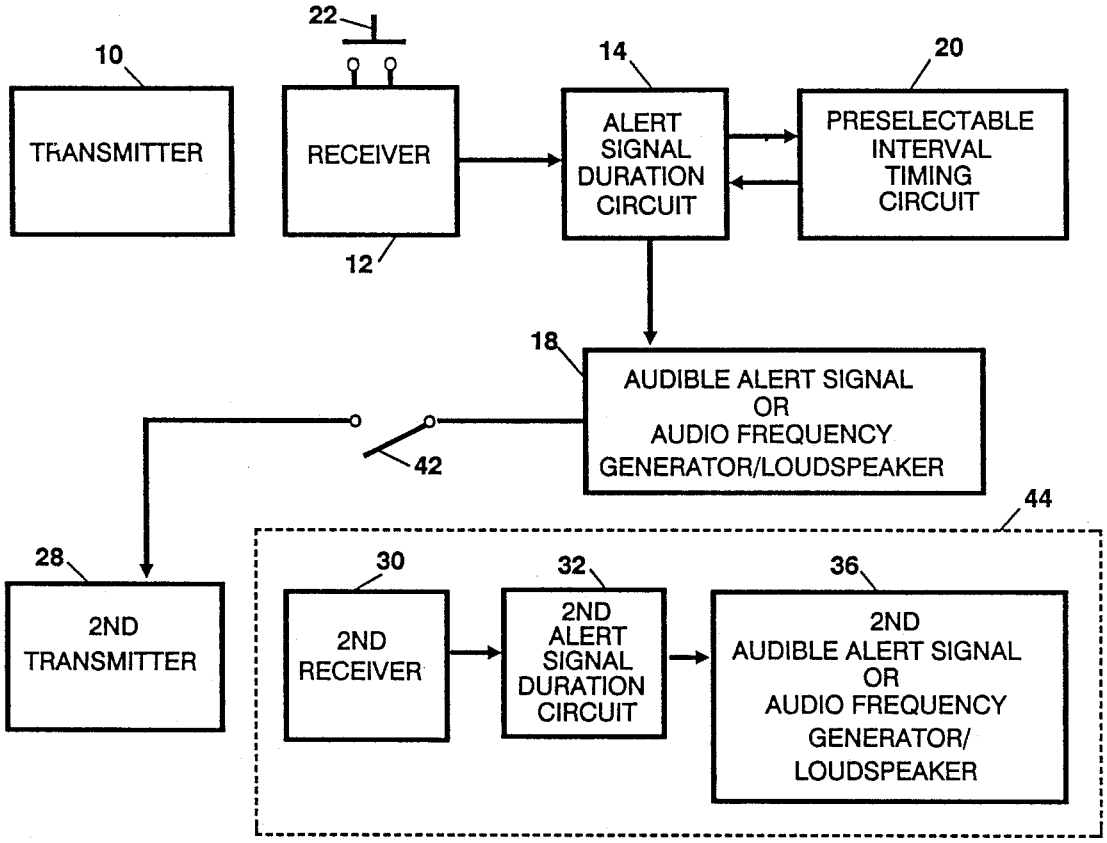
FIG. 4 is a block diagram illustrating an arrangement of the components and circuitry which may make up still another alternative embodiment of the invention.

The block diagram illustrating a circuit for still another alternative embodiment of the invention is shown in FIG. 4. All components including 10, 12, 14, 18, 20 and 22, remain the same as in FIG. 1. The difference being the addition of a second EMR transmitter 28 plus a second physical audible alert signal group 44. Through the use of switch 42, a second EMR transmitter 28, being of a different frequency than the first EMR transmitter 10, is either inserted or deleted from the circuit. The second EMR transmitter 28, is activated each time a audible alert signal is produced. The second EMR receiver 30 receives the EMR signal from the 2nd EMR transmitter 28. The 2nd alert signal duration circuit 32 is coupled to the output stage of the 2nd EMR receiver 30. During the energized time period of the 2nd alert signal duration circuit 32, the 2nd audible alert signal or audio frequency generator/loudspeaker 36 is activated.

The operation is identical to the operation in FIG. 1 except that when the catering driver initiates the coffee break or lunch break timing with transmitter 10, the 2nd transmitter 28 is also activated which in turn sends a different EMR signal to a 2nd receiver 30 at a distant location. The output stage of the 2nd receiver 30 activates a 2nd alert signal duration circuit 32 sending power to a 2nd audible alert signal or audio frequency generator/loudspeaker 36. Each time the first audible alert signal 18 is activated, the 2nd sensible alert signal 36 is also activated.

While the invention has been described with particular reference to the embodiments shown in the drawings, it is to be understood that this description represents only the preferred and various alternative embodiments of the present invention. It will be apparent to those skilled in the art that many modifications of these embodiments may be made without departing from the scope of the present invention, which is defined in the appended claims.

I claim:

1. A remotely activated timer alert system for signaling, when remotely activated, the beginning and end of a preselected time interval, comprising in combination;

transmitter means selectively operable to transmit an EMR (electromagnetic-radiation) signal;

receiver means for receiving and responding to said EMR signal, said receiver means having a receiver output with a high output impedance when said EMR signal is not received and a low output impedance when said EMR signal is received;

alert signaling means, coupled to said receiver output, having an alert operational cycle and a standby mode of operation in which it responds to said output impedance by initiating and completing said alert operational cycle, said alert operational cycle comprising: (1) producing a first audible alert signal upon transition of said receiver output from said high to said low impedance, and (2) producing a second audible alert signal at a preselected time interval after said first audible alert signal;

said alert signaling means responding to said output impedance only when in said standby mode of operation, and ignoring output-impedance transitions occuring during said operational cycle.

2. The apparatus of claim 1 wherein said alert signaling means comprises:

first timing circuit means for fixing the length of said preselected time interval, said first timing circuit means being preselectably adjustable to a first time interval.

3. The apparatus of claim 2 wherein said alert signaling means further comprises:

second timing circuit means for fixing the length of said preselected time interval, said second timing circuit means being preselectably adjustable to a second time interval; and, timing circuit selector means for causing either said first or second timing circuit means to fix the length of said preselected time interval.

4. The apparatus of claim 3 wherein said timing circuit selector means causes said first and second timing circuit means, upon successive alert operational cycles, to alternate in fixing the length of said preselected time interval, whereby said preselected time interval has a length which alternates between said first and second time intervals for successive alert operational cycles.

5. The apparatus of claim 1 further comprising:

override switch means, coupled to said alert signaling means, and being manually operable for initiating said alert operational cycle.

6. The apparatus of claim 1 wherein said EMR signal is a radio-frequency signal.

7. The apparatus of claim 1 wherein said alert signaling means comprises an audio frequency generator coupled to and driving a loudspeaker.

8. The apparatus of claim 1 further comprising:

alert signal duration-determining means, coupled to said alert signaling means, for causing said audible alert signals produced by said alert signaling means to continue for a preselected time duration.

9. The apparatus of claim 1 wherein said alert signaling means further comprises:

warning signal means for producing an audible warning signal during said preselected time interval at a preselected time prior to said second audible signal.

10. The apparatus according to claim 9 wherein said alert signaling means further comprises:

warning switch means selectively operable in a first switch state in which said warning signal means is activated to produce said audible warning signal during said preselected time interval, and a second switch state which said warning signal means is deactivated to eliminate said warning signal.

11. The apparatus according to claim 1 further comprising:

second transmitter means, coupled to said alert signaling means, for responding thereto by transmitting a second EMR signal when each of said first and second audible alert signals are produced;

second receiver means for receiving and responding to said second EMR signal, said second receiver means having a second receiver output with a second high output impedence when said second EMR signal is not received, and a second low output impedence when said second EMR signal is received;

second alert signaling means, coupled to said second receiver output, producing an audible alert signal upon transition of said second receiver output from said second high output impedence to said second low output impedance.

12. The apparatus according to claim 11 further comprising:

remote-alarm switch means coupled between said second transmitter means and said alert signaling means, and being operable in a remote-enable state in which said second transmitter means is enabled, and being operable in a remote-disable state in which said second transmitter means is disabled.

* * * * *